US011629305B2

(12) United States Patent
Jois et al.

(10) Patent No.: US 11,629,305 B2
(45) Date of Patent: Apr. 18, 2023

(54) FUEL COMPOSITION WITH LUBRICITY ADDITIVES

(71) Applicant: SHELL OIL COMPANY, Houston, TX (US)

(72) Inventors: Yajnanarayana Halmuthur Jois, Houston, TX (US); Joseph Michael Russo, Houston, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/422,342

(22) PCT Filed: Feb. 6, 2020

(86) PCT No.: PCT/EP2020/053038
§ 371 (c)(1),
(2) Date: Jul. 12, 2021

(87) PCT Pub. No.: WO2020/161262
PCT Pub. Date: Aug. 13, 2020

(65) Prior Publication Data

US 2022/0106534 A1 Apr. 7, 2022

Related U.S. Application Data

(60) Provisional application No. 62/802,229, filed on Feb. 7, 2019.

(51) Int. Cl.

| | |
|---|---|
| ***C10L 10/08*** | (2006.01) |
| ***C10L 1/19*** | (2006.01) |
| ***C10L 1/224*** | (2006.01) |
| ***C10L 1/188*** | (2006.01) |

(52) U.S. Cl.
CPC ..... *C10L 10/08* (2013.01); *C10L 1/1881* (2013.01); *C10L 1/19* (2013.01); *C10L 1/224* (2013.01);
(Continued)

(58) Field of Classification Search
CPC ..... C10L 10/08; C10L 1/1881; C10L 1/224; C10L 2270/023; C10L 1/14; C10L 1/19;
(Continued)

(56) References Cited

U.S. PATENT DOCUMENTS

| | | | |
|---|---|---|---|
| 4,198,931 | A | 4/1980 | Malec |
| 6,835,217 | B1 | 12/2004 | DeRosa et al. |

(Continued)

FOREIGN PATENT DOCUMENTS

| | | | |
|---|---|---|---|
| CN | 106190371 | A | 12/2016 |
| EP | 3144371 | A1 | 3/2017 |
| WO | 9417160 | A1 | 8/1994 |

OTHER PUBLICATIONS

International Search Report and Written Opinion received for PCT Patent Application No. PCT/EP2020/053038, dated Jun. 24, 2020, 15 pages.

(Continued)

*Primary Examiner* — Ellen M McAvoy
*Assistant Examiner* — Chantel L Graham
(74) *Attorney, Agent, or Firm* — Shell USA, Inc.

(57) ABSTRACT

A fuel composition comprising a fuel and a lubricity additive where the lubricity additive is selected from (1) 1-Lauroyl-rac-glycerol, (2) Dodecanamide, N-hydroxy-, or (3) 2-Ethylhexanoic acid and the fuel is gasoline.

6 Claims, 6 Drawing Sheets

(52) U.S. Cl.
CPC . *C10L 2200/0423* (2013.01); *C10L 2270/023* (2013.01)

(58) Field of Classification Search
CPC ..... C10L 1/191; C10L 2200/0423; C10L 2270/02
See application file for complete search history.

(56) References Cited

U.S. PATENT DOCUMENTS

| | | | | |
|---|---|---|---|---|
| 6,866,690 | B2 | 3/2005 | Aradi et al. | |
| 9,011,556 | B2 | 4/2015 | Schwab | |
| 10,975,322 | B2 | 4/2021 | Racha et al. | |
| 2003/0056431 | A1 | 3/2003 | Schwab et al. | |
| 2008/0255011 | A1* | 10/2008 | Poirier | C10M 169/04 508/463 |
| 2011/0146143 | A1 | 6/2011 | Alexander | |
| 2018/0094203 | A1* | 4/2018 | Gunawan | C10L 1/18 |
| 2020/0140771 | A1* | 5/2020 | Gunawan | C10L 1/14 |
| 2020/0157449 | A1* | 5/2020 | Bhowmik | C10L 10/08 |

OTHER PUBLICATIONS

Office Action Received for Chinese Application No. 202080012946.3, dated Jun. 22, 2022, 14 Pages(7 Pages of English Translation and 7 Pages of Official Copy).
Office Action Received for Indian Application No. 202117035391, dated Feb. 13, 2023, 6 Pages (6 Pages of Official Copy).

* cited by examiner

FUEL COMPOSITION WITH LUBRICITY ADDITIVES

CROSS REFERENCE TO RELATED APPLICATIONS

This is a National stage application of International application No. PCT/EP2020/053038, filed 6 Feb. 2020, which claims priority of U.S. provisional application No. 62/802,229, filed 7 Feb. 2019, which is incorporated herein by reference in its entirety.

FIELD OF INVENTION

The present invention relates to fuel compositions comprising a base fuel and a lubricity additive, and more particularly, fuel compositions comprising a base fuel and a lubricity additive suitable for use in an internal combustion engine, a method for improving lubricity of a fuel composition, and a method for improving fuel performance of a direct injection engine.

BACKGROUND

Engine manufacturers are continuously challenged to improve engine efficiency and maximize power output, especially when designing internal combustion engines. Such engines are known to have low efficiency since a portion of the combusted fuel is not converted into useful energy but is used to overcome frictional forces. More typically, a significant portion of energy available from the combusted fuel is used to overcome frictional forces generated between surfaces of moving engine parts that are in mutual contact. The energy expended to overcome such frictional forces is considered as energy loss, or frictional loss. When higher energy requirements are necessary to overcome such losses, the amount of useful energy available to operate the engine is often reduced. To improve engine and fuel efficiency, current trends include using friction-reducing additives, friction-reducing fuel additives, or surface coatings, among others, in an effort to reduce engine frictional losses.

Friction-reducing additives, also known as friction modifiers, may be used as additives in lubricants to improve both engine and fuel efficiency. While it is understood that lubricants reduce friction between moving surfaces, the addition of friction-reducing additives to a lubricant composition may further reduce frictional losses without modifying other lubricant physical properties, such as viscosity, density, pour point, and the like. Moreover, to meet the increasing demand for more fuel-efficient vehicles, friction-reducing additives may be incorporated into fuel compositions. For example, a fuel composition comprising friction-reducing additives may be used to deliver friction modifying properties to a piston ring-cylinder wall interface of an engine where friction is high but the quantity of lubricant that flows into the area is low.

U.S. Pat. No. 6,866,690 describes a friction modifier prepared by combining saturated carboxylic acid salt and an alkylated amine and for use in a combustible fuel composition. The friction modifier can be made, for example, by mixing (i) a branched saturated carboxylic acid, or mixtures thereof, with (ii) a mono- and/or di-alkylated monoamine, and/or a mono- and/or di-alkylated polyamine, at an approximately 1:1 molar ratio. Boundary friction coefficients for the described friction modifiers were measured using a PCS Instruments High Frequency Reciprocating Rig, in which a 4 Newton (N) load was applied between a 6-millimeter (mm) diameter ANSI 52100 steel ball and an ANSI 52100 steel flat.

U.S. Pat. No. 9,011,556 describes a middle distillate fuel composition containing hydrocarbyl-substituted succinimide in a friction modifying amount. The middle distillate fuel composition was subjected to a High Frequency Reciprocating Rig (HFRR), described in ASTM method D6079, where the average HFRR wear scar diameter was recorded.

U.S. Pat. No. 6,835,217 describes a fuel composition containing a hydrocarbon fuel and a friction modifying component, which is a reaction product of at least one natural or synthetic oil and at least one alkanolamine. Lubricity tests were carried out using a High Frequency Reciprocating Rig (HFRR), described in ASTM method D6079-97, and wear scar diameter measurements were calculated based on major and minor axes.

U.S. Patent Pub. No. 2011/0146143 describes a fuel composition containing a friction reducing component for use in an internal combustion engine. The friction reducing component comprises at least one $C_6$ to $C_{30}$ aliphatic amine, including saturated fatty acid amines, unsaturated fatty acid amines, and mixtures thereof. A SRV test rig was utilized to measure the friction coefficient and wear scar performance of the components.

Many internal engine components, such as fuel pumps and injectors, are prone to excessive wear and metal damage (i.e., corrosion, erosion) due to frictional forces. Excessive friction often lends to shortened engine life, high engine replacement costs, and inefficient fuel economy since more fuel is needed to operate the engine. Yet, the aforementioned friction-reducing additives produce only marginally improvements in overcoming such challenges and other engine and fuel performance related-issues. Thus, to meet the continuing demand for enhanced friction reduction, a fuel composition is desired that provides exemplary lubricity properties and superior protection against engine frictional losses, wear, deposits, and corrosion.

DESCRIPTION OF THE DRAWINGS

Certain exemplary embodiments are described in the following detailed description and in reference to the drawings, in which.

SUMMARY OF THE INVENTION

Figure 1A:
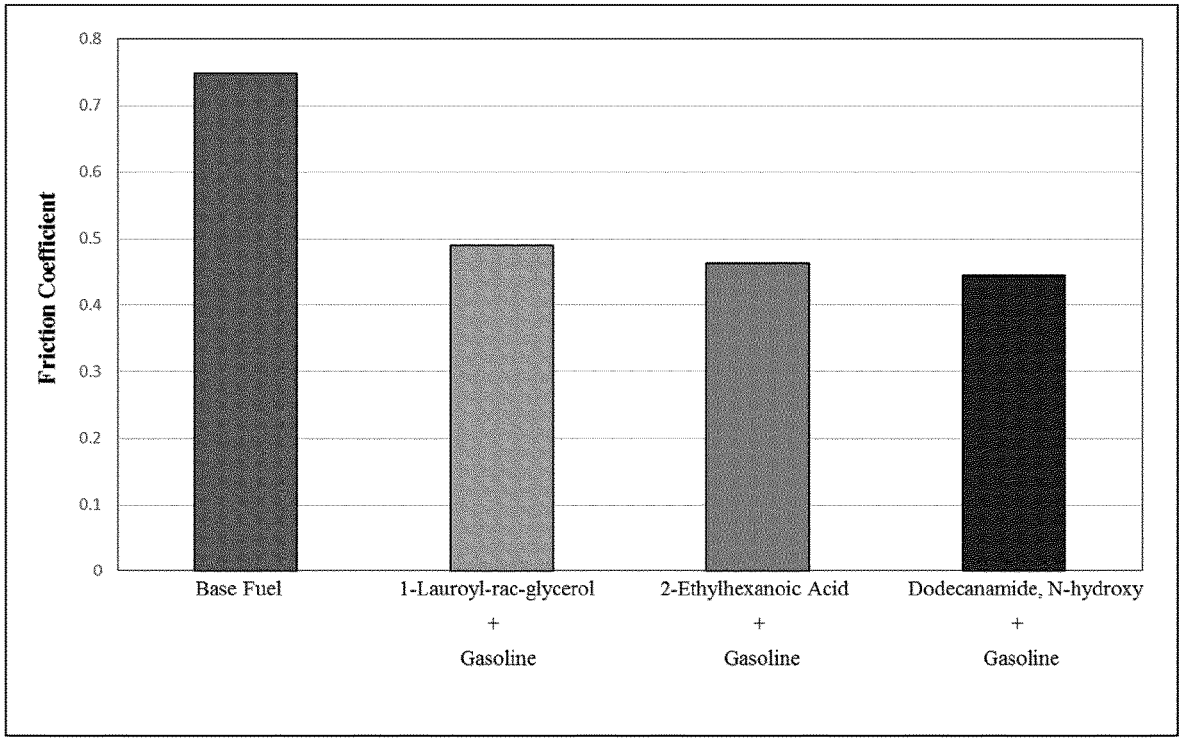
FIG. 1A presents a graphical depiction of friction coefficients for fuel compositions at 50 ppm (wt/v) treat rates during a 0-4500 seconds test run.

Accordingly, the present invention relates to improved fuel compositions. More specifically, each inventive fuel composition contains a hydrocarbon base fuel and a lubricity additive. In accordance with the present invention, the fuel composition specifically comprises gasoline as the base fuel and a lubricity additive selected from 1-Lauroyl-rac-glycerol, Dodecanamide, N-hydroxy-, or 2-Ethylhexanoic acid.

The present invention further relates to a method for improving lubricity of a fuel composition. In particular, the method includes adding a soluble lubricity additive to a hydrocarbon base fuel to form a fuel composition comprising improved lubricity properties. In accordance with the present invention, the method specifically comprises adding a lubricity additive selected from 1-Lauroyl-rac-glycerol, Dodecanamide, N-hydroxy-, or 2-Ethylhexanoic acid to gasoline, selected as the preferred base fuel.

The present invention also relates to a method of improving the fuel performance of a direct injection engine. More specifically, the present invention describes a method of fueling a direct injection engine with a fuel composition comprising a hydrocarbon base fuel and a lubricity additive. In accordance with the present invention, the fuel composition, as used in the direct injection engine, comprises gasoline as the base fuel and a lubricity additive selected from one of 1-Lauroyl-rac-glycerol, Dodecanamide, N-hydroxy-, or 2-Ethylhexanoic acid.

DETAILED DESCRIPTION

Moving machine assemblies, such as internal combustion engines, are prone to frictional losses which constitute a major portion of engine inefficiency. Frictional losses occur among engine components such as crankshaft, bearings, piston, piston rings, piston skirts, valves and valve guides, pulleys, timing belts, and connecting rods, among others. For example, reciprocating parts, such as the piston and piston rings, are the highest contributors, up to 50%, of all frictional losses among the various engine components. While it is not possible to completely eliminate friction generated during engine operations, applications such as lubricants, surface coatings, and fuels are typically used in an effort to reduce frictional losses. A lubricant generally reduces friction based on its behavior upon surface contact and/or on its ability to impose viscous shear stress on moving engine components. Current trends by some automotive manufacturers include developing surface coating to also reduce friction coefficients. Additionally, certain fuel compositions have been formulated to lower friction losses between moving components.

The present invention relates to several fuel compositions where each fuel composition comprises an individual lubricity additive. Specifically, each embodiment of the fuel composition comprises a hydrocarbon base fuel and a selected lubricity additive to reduce friction through surface adsorption as the composition comes into contact with moving engine parts. For instance, upon entering the combustion chamber, the lubricity additive of the inventive fuel composition adsorbs onto oil films located on combustion chamber engine walls to act as an anti-friction layer between moving parts to prevent metal-to-metal contact, thus, reducing frictional losses at surface contact.

There are areas of the engine that are lubricant wetted, or that come into direct contact with the lubricant, such as the engine bearing compartment. However, there are engine components that make contact with the fuel composition, and not the lubricant (i.e., non-lubricant wetted components), that could benefit from enhanced lubricating properties. In the present embodiments, the inventive fuel composition behaves as a lubricating source for internal engine components that are both lubricant wetted and non-lubricant wetted. For example, the lubricity additive of the inventive fuel composition may flow unchanged from the combustion chamber to the oil sump so as to accumulate over time and mix with engine lubricants, i.e., engine oils, within the oil sump. In this regard, the inventive fuel composition acts as an additional lubricant source for lubricant wetted components, such as the camshaft, crankshaft, and intake valves. Additionally, in a port fuel injection (PFI) engine, the intake valves are exposed to fuel just prior to entering the combustion chamber. Therefore, exposure to the present fuel composition not only helps to remove deposit formation but also aids in lubricating the valve stem in a valve guide. Yet, there are some areas of the engine, such as fuel injectors and fuel pumps, where the inventive fuel composition delivers the friction-reducing lubricity additive while the lubricant quantity is purposely maintained at a minimal level. Overall, the inventive fuel composition comprising the lubricity additive substantially reduces friction among a wide range of moving engine parts, especially towards the end of an oil drain interval when lubricant chemistry is depleted and is no longer effective.

It has been surprisingly found that engines using the inventive fuel compositions exhibited significant engine improvements, including reductions in frictional losses and improved wear resistance, over engines using fuel compositions containing conventional friction-reducing additives or containing only a base fuel. For example, test data for each inventive fuel composition exhibited compelling lubricity improvements as shown by reduced friction coefficients and wear scar values as compared to that of typical fuels. Each inventive fuel composition containing a lubricity additive also showed synergistic behavior with respect to improved engine protection including lower engine deposits and corrosive behavior. It is well-known to one skilled in the art that a reduction in friction loss often translates into higher engine output and better fuel efficiency. Therefore, another advantage as provided by the inventive fuel compositions includes increased fuel performance and improved fuel economy.

As used, herein the term "lubricity" refers to the ability, or property, of a fuel composition to reduce friction between engine component parts.

As used herein, the terms "lubricity additives" or "lubricity improvers" refer to an additive added to a base fuel composition to improve lubricity properties, thus, leading to a reduction in friction, wear, deposits, and corrosion among engine component parts.

The base fuel of the present fuel composition includes a hydrocarbon base fuel suitable for use in an internal combustion engine of the spark-ignition (petrol) type known in the art, including automotive engines and other types of engine such as off-road and aviation engines. Preferably, the base fuel comprises gasoline or a gasoline-based fuel, herein referred to as "gasoline". For example, the base fuel may include a common blend of gasoline and ethanol, such as E85 fuel which includes 15% gasoline and 85% ethanol. The amount of gasoline in the fuel can vary (typically from 15% to 90% by volume) based on geographical region and season, thereby, including an ethanol content ranging from E10 to E85.

Gasoline can include volatile hydrocarbons boiling in the range of from about 25° C. (77° F.) to about 220° C. (428° F.) and can be derived from straight-chain naphtha, polymer gasoline, natural gasoline, catalytically cracked or thermally cracked hydrocarbons, catalytically reformed stocks, or mixtures thereof. Also, gasoline blending components which are derived from a biological source are also suitable for use.

The volatile hydrocarbons can be selected from one or more of the following groups, including, saturated hydrocarbons, olefinic hydrocarbons, aromatic hydrocarbons, oxygenated hydrocarbons, and mixtures thereof. The octane level of the gasoline will generally be above about 85. The specific hydrocarbon composition and octane level of the base fuel are not critical in the present embodiments.

Typically, the saturated hydrocarbon content of the gasoline ranges from 40% to about 80% by volume and the oxygenated hydrocarbon content ranges from 0% to about 35% by volume. When the gasoline comprises oxygenated hydrocarbons, at least a portion of non-oxygenated hydrocarbons will be substituted for oxygenated hydrocarbons. The oxygen content of the gasoline may be up to 35% by weight (EN 1601) (e.g. ethanol per se) based on the gasoline. For example, the oxygen content of the gasoline may be up to 25% by weight, preferably up to 10% by weight. Conveniently, the oxygenate concentration will have a minimum concentration selected from any one of 0, 0.2, 0.4, 0.6, 0.8, 1.0, and 1.2% by weight, and a maximum concentration selected from any one of 5, 4.5, 4.0, 3.5, 3.0, and 2.7% by weight.

Typically, the olefinic hydrocarbon content of the gasoline ranges from 0% to 40% by volume based on the gasoline (ASTM D1319). Preferably, the olefinic hydrocarbon content ranges from 0% to 30% by volume based on the gasoline, more preferably, the olefinic hydrocarbon content ranges from 0% to 20% by volume based on the gasoline. The aromatic hydrocarbon content of the gasoline ranges from 0% to 70% by volume based on the gasoline (ASTM D1319). For instance, the aromatic hydrocarbon content of the gasoline ranges from 10% to 60% by volume based on the gasoline. Preferably, the aromatic hydrocarbon content of the gasoline ranges from 10% to 50% by volume based on the gasoline, and more preferably, the aromatic hydrocarbon content ranges from 10% to 50% by volume based on the gasoline.

Gasoline may also contain mineral carrier oils, synthetic carrier oils, mixtures thereof, and/or solvents. Examples of suitable mineral carrier oils include fractions obtained in crude oil processing, such as brightstock or base oils, and fractions obtained in the refining of mineral oil such as hydrocrack oil. Examples of suitable synthetic carrier oils include polyolefins (poly-alpha-olefins or poly(internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated). Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mole of ethylene oxide and/or propylene oxide and/or butylene oxide per hydroxyl group or amino group, and, in the case of the polyether amines, by subsequent reductive amination with ammonia, monoamines or polyamines.

Examples of carboxylic esters of long-chain alkanols are in particular esters of mono-, di- or tricarboxylic acids with long-chain alkanols or polyols. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Other examples of suitable synthetic carrier oils are alcohol-started polyethers having from about 5 to 35 $C_3$-$C_6$-alkylene oxide units, selected from propylene oxide, n-butylene oxide and isobutylene oxide units, or mixtures thereof, for example. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical where preferred examples include tridecanol and nonylphenol.

The benzene content of the gasoline is at most 10% by volume, more preferably at most 5% by volume, and most preferably at most 1% by volume based on the gasoline. The gasoline preferably has a low or ultra-low sulphur content, for instance at most 1000 ppmw (parts per million by weight), preferably no more than 500 ppmw, more preferably no more than 100, even more preferably no more than 50 and most preferably no more than even 10 ppmw. Moreover, the gasoline preferably has a low total lead content, such as at most 0.005 grams/liter (g/l), most preferably being lead free, thus, having no lead compounds added thereto (i.e., unleaded). The gasoline as used in the present invention may be substantially free of water since water could impede smooth combustion.

Each fuel composition of the present invention includes only one type of lubricity additive. In this regard, the lubricity additive is selected as an individual component from commercially available 1-Lauroyl-rac-glycerol, Dodecanamide, N-hydroxy- or 2-Ethylhexanoic acid, where each additive was selected based on its ability to effectively improve lubricity. In the present embodiments, each lubricity additive is adequately soluble, preferably totally soluble, in a base fuel to produce the fuel composition and does not interfere or impose negative interactions with other additives that may be optionally added to the composition. Each individual lubricity additive is blended with a respective base fuel at a concentration of about 5 ppm (part per million) to about 100 ppm by weight, based on the total weight of the fuel composition.

The molecules of each lubricity additive include a polar head group and a non-polar tail group. The polar head group of the molecules is attracted to metal surfaces, and therefore, binds relatively strongly but reversible to such surfaces, i.e., capable of lifting and moving. With surface modifications or with impregnated ceramic fibers, the polar head group may be attracted to other surfaces, such as an alumina surface. The non-polar tail group of the molecules can be slightly longer than the molecules of the base fuel, i.e., greater than 15 atoms long, and can include a configuration that is non-linear, branched, or bent so as to enable molecule packing and fluid flow. The non-polar tail group is a hydrocarbon and thus, it can solubilize the entire molecule in the hydrocarbon base fuel. Due to the nature of the polar head group and the structure of the non-polar tail group for each lubricity additive, the inventive fuel composition surprisingly impacts engine efficiency and performance by reducing friction amongst engine components.

1-Lauroyl-rac-glycerol, as shown by (1), is formed by glycerol ester (polar head group) and lauric acid derivatives (non-polar tail group). Glycerol ester is multi-functional and typically stable when grafting to an acid. Lauric acid derivatives include molecules that are typically larger than base fuel molecules but smaller than the molecules of conventional friction modifiers.

(1)

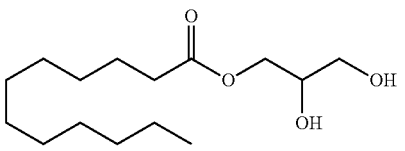

Dodecanamide, N-hydroxy-, as shown by (2), is a N-hydroxyamide derivative and is formed by N-hydroxyamide (polar head group) and lauric acid derivatives (non-polar tail group). N-hydroxyamide suitability is based on its multi-functional behavior and compact molecules. Lauric acid derivatives include molecules that are typically larger than base fuel molecules but smaller than the molecules of conventional friction modifiers.

(2)

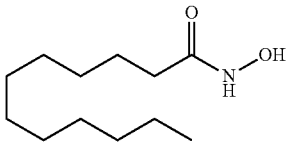

2-Ethylhexanoic acid, as shown by (3), is formed by carboxylic acid (polar head group) and 2-Ethylexanoic acid derivatives (non-polar tail group). Carboxylic acid is typically available on the suggested non-polar tail groups. The 2-Ethylexanoic acid derivatives include branched molecules similar in size to the molecules of the base fuel.

(3)

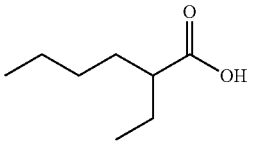

Through surface adsorption, the lubricity additive reduces the frictional properties of metal-to-metal interfaces. Specifically, the combination of flexible and multi-functional head groups along with the slightly longer tail groups enable the selected lubricity additives, including 1-Lauroyl-rac-glycerol, Dodecanamide, N-hydroxy-, and 2-Ethylhexanoic acid, to attach to multiple sites or adsorb on a metal surface, thus, exhibiting exemplary surface adherence.

While not critical to the present invention, the fuel gasoline composition of the present invention may further include one or more optional fuel additives, in addition to the selected lubricity additives mentioned above. It should be noted that the concentration and nature of the optional fuel additive(s) in the present invention is not critical. However, the concentration of any optional fuel additive(s) present in the fuel composition can be preferably up to 1% by weight of the total fuel composition, more preferably in the range from 5 to 2000 ppmw, and most preferably in the range of from 90 to 1500 ppmw, such as from 90 to 1000 ppmw. Non-limiting examples of optional fuel additives include, but are not limited to, anti-oxidants, corrosion inhibitors, detergents, dehazers, antiknock additives, metal deactivators, valve-seat recession protectant compounds, dyes, solvents, carrier fluids, diluents and markers.

The invention will be further illustrated in more detail by the following examples. In particular, each example includes blending one of three different lubricity improvers with a base fuel to produce three different fuel compositions. The three lubricity improvers were added to a respective base fuel at treat rates of 50 parts per million (ppm) weight by volume (wt/v) and 25 ppm (wt/v). The three fuel compositions and a conventional base fuel were evaluated for friction and wear scar performance using a modified high frequency reciprocating rig (HFRR) test method for gasoline (ASTM D6079-11). It should be noted that the examples are provided for illustration only and are not to be construed as limiting the present invention in any way.

Example 1

Example 1 presents friction coefficient data for a base fuel and three different fuel compositions, each containing an individual lubricity additive, as identified in Table 1. The base fuel used in each fuel composition included E10 which is a fuel mixture of 90% gasoline and 10% ethanol usable in internal combustion engines of most automobiles and light-duty vehicles without engine or fuel system modifications. The individual lubricity additive added to a respective base fuel included 1-Lauroyl-rac-glycerol, Dodecanamide, N-hydroxy- or 2-Ethylhexanoic acid. No additional additives or the like were added therein. Accordingly, the formulation for each fuel composition as tested included (1) only base fuel, (2) 1-Lauroyl-rac-glycerol and base fuel, (3) Dodecanamide, N-hydroxy- and base fuel and (4) 2-Ethylhexanoic acid and base fuel. The amount of each lubricity additive added to its respective base fuel included 50 ppm (wt/v) based on the total volume of base fuel.

The friction coefficient for each fuel composition was determined using a HFRR (high frequency reciprocating rig) test method at every second of a 0-4500 seconds test run. The initial 900 seconds of the 0-4500 seconds test run exhibited a spike in the friction coefficient which was directly followed by a decrease in the coefficient. The formation of an anti-wear film, a metal oxide film, or smoothening of asperities on the metal surface may have contributed to the initial spike. After the initial 900 seconds, more stabilized friction coefficients were recorded during the remaining 900-4500 seconds of the test run which ensure a more stable platform for comparative purposes. Accordingly, the friction coefficient results, as shown in Table 1, include results for the entire 4500 seconds (i.e., 0-4500 seconds) and results during the remaining 900-4500 seconds (i.e., 900-4500 seconds) of the test run. The HFRR tests of the present embodiments were conducted at 25° C. but can be run at various temperatures and programmed to suit the particular application of the fuel composition being tested.

TABLE 1

Friction Coefficients for Fuel Compositions at 50 ppm (wt/v) Treat Rates

| No. | Fuel Compositions | Concentration of Lubricity Additive (ppm weight by volume) | Friction Coefficient (0-4500 sec) | Friction Coefficient (900-4500 sec) |
|---|---|---|---|---|
| 1 | Base Fuel | N/A. | 0.701 | 0.587 |
| 2 | 1-Lauroyl-rac-glycerol + Base Fuel | 50 | 0.489 | 0.393 |
| 3 | Dodecanamide, N-hydroxy- + Base Fuel | 50 | 0.444 | 0.361 |
| 4 | 2-Ethylhexanoic acid + Base Fuel | 50 | 0.464 | 0.385 |

FIG. 1A presents a graphical depiction of friction coefficients for fuel compositions at 50 ppm (wt/v) treat rates during a 0-4500 seconds test run. Each fuel composition containing a lubricity additive exhibited a lower friction coefficient than the base fuel without additives during the 0-4500 second test run, even with a spike in the friction coefficient during the initial 900 seconds of the test run. As provided in Table 1 and as shown in FIG. 1A, the base fuel exhibited a mean friction coefficient of about 0.701. However, fuel composition no. 2 (1-Lauroyl-rac-glycerol+Base Fuel) exhibited a coefficient of friction of about 0.489, fuel composition no. 3 (Dodecanamide, N-hydroxy-+Base Fuel) exhibited a friction of coefficient of about 0.444, and fuel composition no. 4 (2-Ethylhexanoic acid+Base Fuel) exhibited a coefficient of friction of about 0.464. When determined using the HFRR test method, each of the fuel compositions provided improvements in friction properties by providing a lower friction coefficient as compared to the friction coefficient of the base fuel.

Figure 1B:
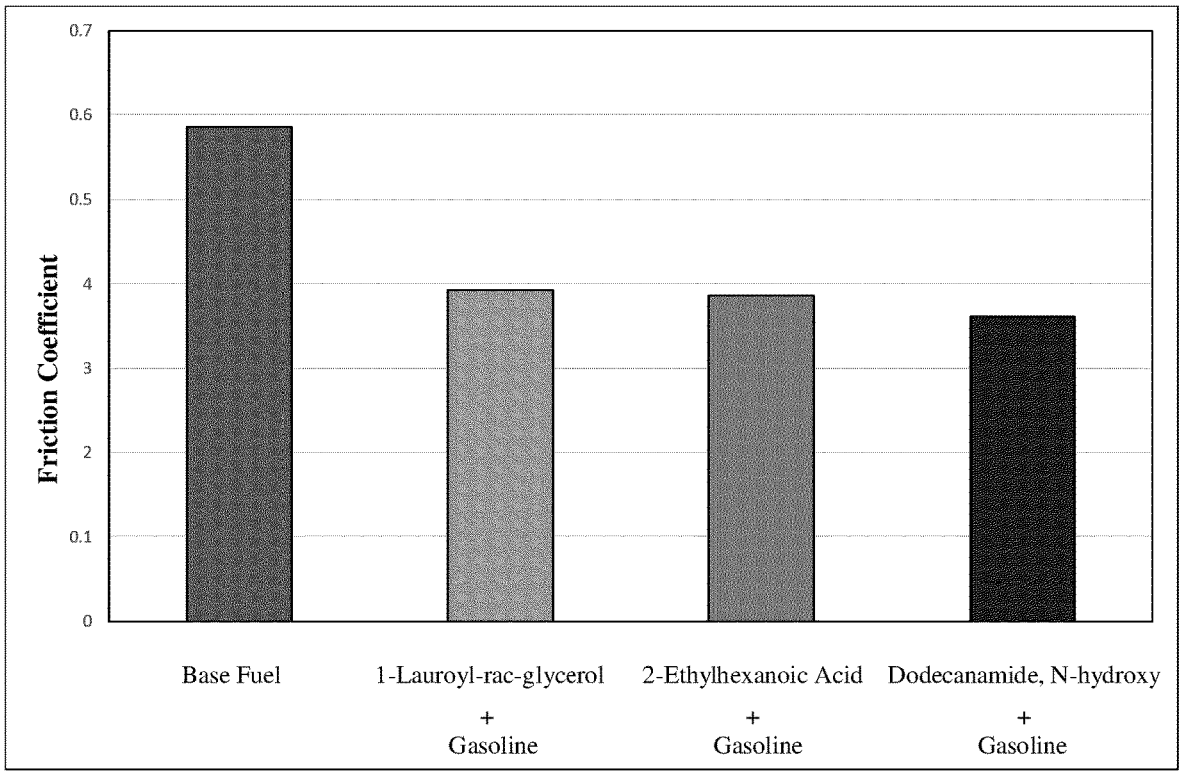
FIG. 1B presents a graphical depiction of friction coefficients for fuel compositions at 50 ppm (wt/v) treat rates during a 900-4500 seconds test run.

FIG. 1B presents a graphical depiction of friction coefficients for fuel compositions at 50 ppm (wt/v) treat rates during a 900-4500 seconds test run. As provided in Table 1 and as shown in FIG. 1B, each fuel composition containing a lubricity additive exhibited a lower friction coefficient than the base fuel without additives during the 900-4500 second test run. In particular, the base fuel exhibited a mean friction coefficient of about 0.587. However, fuel composition no. 2 (1-Lauroyl-rac-glycerol+Base Fuel) exhibited a coefficient of friction of about 0.393, fuel composition no. 3 (Dodecanamide, N-hydroxy-+Base Fuel) exhibited a coefficient of friction of about 0.361, and fuel composition no. 4 (2-Ethylhexanoic acid+Base Fuel) exhibited a coefficient of friction of about 0.385. Each of the fuel compositions provided improvements in friction properties by providing a lower friction coefficient as compared to the friction coefficient of the base fuel.

Example 2

Example 2 presents comparative friction coefficient data for fuel compositions containing an individual lubricity additive, as identified in Table 2, at a lower lubricity treat rate of 25 ppm (wt/v) as compared to a lubricity treat rate of 50 ppm (wt/v). The base fuels used in Example 2 are as described with respect to Example 1. The selected lubricity additives, including Dodecanamide, N-hydroxy- and 1-Lauroyl-rac-glycerol, were individually added to a respective base fuel. No additional additives or the like were added therein. Accordingly, the formulations tested included comparing fuel composition no. 1 (Dodecanamide, N-hydroxy-+Base Fuel) at a treat rate of 50 ppm (wt/v) with fuel composition no. 2 (Dodecanamide, N-hydroxy-+Base Fuel) at a treat rate of 25 ppm (wt/v). Additionally, fuel composition no. 3 (1-Lauroyl-rac-glycerol+Base Fuel) at a treat rate of 50 ppm (wt/v) was compared with fuel composition no. 4 (1-Lauroyl-rac-glycerol+Base Fuel) at a treat rate of 25 ppm (wt/v). The friction coefficient for each fuel composition was determined using a HFRR test method at every second of a 900-4500 seconds test run.

TABLE 2

Comparison of Friction Coefficients for Fuel Compositions at 50 ppm (wt/v) and at 25 ppm (wt/v) Treat Rates

| No. | Fuel Compositions | Concentration of Lubricity Additive (ppm weight by volume) | Friction Coefficient (900-4500 sec) |
|---|---|---|---|
| 1 | Dodecanamide, N-hydroxy- + Base Fuel | 50 | 0.361 |
| 2 | Dodecanamide, N-hydroxy- + Base Fuel | 25 | 0.382 |
| 3 | 1-Lauroyl-rac-glycerol + Base Fuel | 50 | 0.393 |
| 4 | 1-Lauroyl-rac-glycerol + Base Fuel | 25 | 0.432 |

Figure 2:
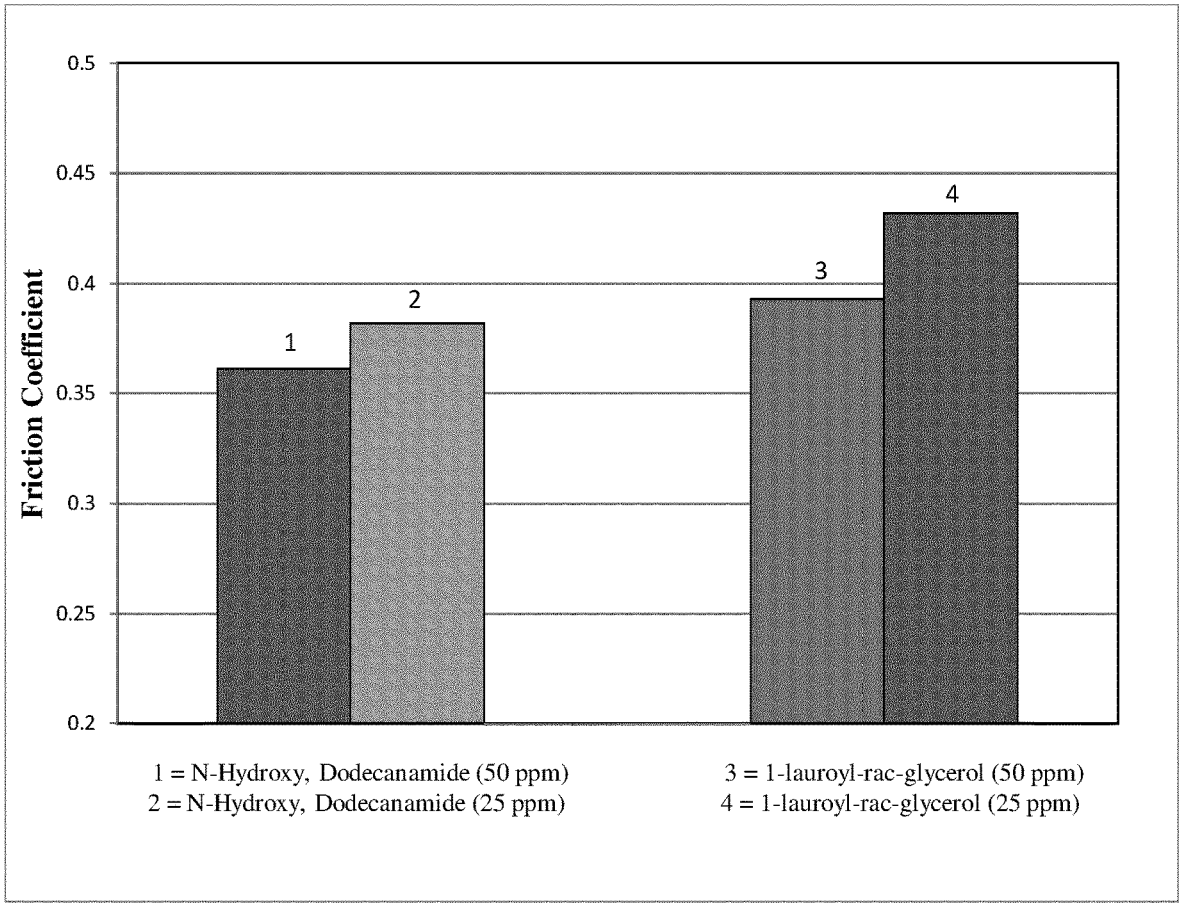
FIG. 2 presents a graphical depiction that compares friction coefficients for fuel compositions at a 50 ppm (wt/v) treat rate and at a 25 ppm (wt/v) treat rate during a 900-4500 seconds test run.

FIG. 2 presents a graphical depiction that compares the friction coefficients for fuel compositions at a 50 ppm (wt/v) treat rate and at a 25 ppm (wt/v) treat rate during the 900-4500 second test run. The effects that the dose rates have on the friction coefficient parameter can be further understood by testing of the various fuel compositions at lower lubricity additives treat rates. As provided in Table 2 and as shown in FIG. 2, fuel composition no. 1 (Dodecanamide, N-hydroxy-+Base Fuel) at a 50 ppm (wt/v) treat rate exhibited a coefficient of friction of about 0.361 while fuel composition no. 2 (Dodecanamide, N-hydroxy-+Base Fuel) at a 25 ppm (wt/v) treat rate exhibited a coefficient of friction of about 0.382. Additionally, fuel composition no. 3 (1-Lauroyl-rac-glycerol+Base Fuel) at a 50 ppm (wt/v) treat rate exhibited a coefficient of friction of about 0.393 while fuel composition no. 4 (1-Lauroyl-rac-glycerol+Base Fuel) at a 25 ppm (wt/v) treat rate exhibited a coefficient of friction of about 0.432. In each instance, the fuel compositions comprising a lubricity additive at a 50 ppm (wt/v) treat rate exhibited a lower friction coefficient than the fuel compositions comprising a lubricity additive at a 25 ppm (wt/v) treat rate. However, the friction coefficients for all of the fuel compositions, as described with respect to Example 2, were lower than the friction coefficient of about 0.587 for the base fuel, as provided in Example 1. Accordingly, each of the fuel compositions of Example 2 provided improvements in friction properties by providing a lower friction coefficient as compared to the friction coefficient of the base fuel.

Example 3

Example 3 presents wear scar values for a base fuel and three different fuel compositions containing an individual lubricity additive, as identified in Table 3. The base fuel is described with respect to Example 1. Individual lubricity additives added to a respective base fuel included 1-Lauroyl-rac-glycerol, Dodecanamide, N-hydroxy- and 2-Ethylhexanoic acid. No additional additives or the like were added therein. Accordingly, the formulation for each fuel composition as tested included (1) only base fuel, (2) 1-Lauroyl-rac-glycerol and base fuel, (3) Dodecanamide, N-hydroxy- and base fuel and (4) 2-Ethylhexanoic acid and base fuel. The amount of each lubricity additive added to its respective base fuel included 50 ppm (wt/v) based on the total volume of base fuel. Wear scar values for each fuel composition were determined using a HFRR test method provided in micrometers (μm).

TABLE 3

Wear Scar Data for Fuel Compositions at 50 ppm (wt/v) Treat Rates

| No. | Fuel Compositions | Concentration of Lubricity Additive (ppm weight by volume) | Wear Scar (micrometer (μm)) |
|---|---|---|---|
| 1 | Base Fuel | N/A | 818.9 |
| 2 | 1-Lauroyl-rac-glycerol + Base Fuel | 50 | 758.0 |
| 3 | Dodecanamide, N-hydroxy- + Base Fuel | 50 | 677.0 |
| 4 | 2-Ethylhexanoic acid + Base Fuel | 50 | 692.5 |

Figure 3:
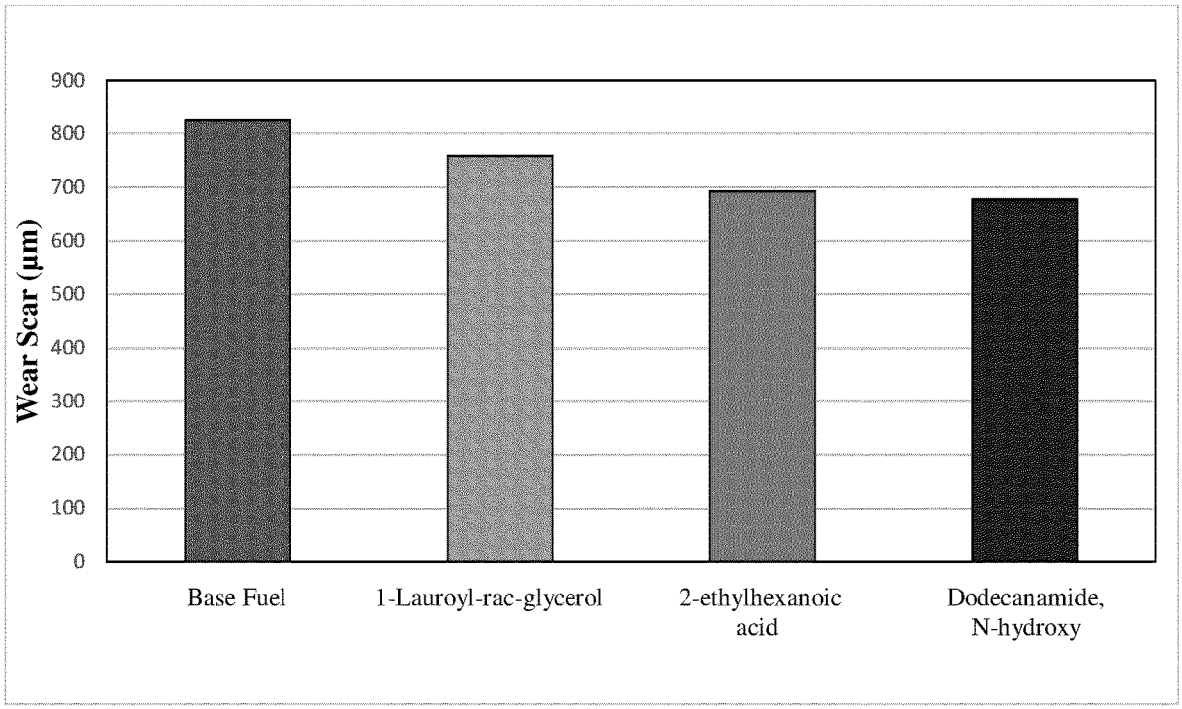
FIG. 3 presents a graphical depiction of wear scar values for fuel compositions at 50 ppm (wt/v)

FIG. 3 presents a graphical depiction of wear scar data for fuel compositions at 50 ppm (wt/v). As provided in Table 3 and as shown in FIG. 3, each fuel composition containing a lubricity additive exhibited a lower wear scar than the base fuel without additives. In particular, the base fuel exhibited a wear scar of about 818.9 μm. However, fuel composition no. 2 (1-Lauroyl-rac-glycerol+Base Fuel) exhibited a wear scar of about 758.0 μm, fuel composition no. 3 (Dodecanamide, N-hydroxy-+Base Fuel) exhibited a wear scar of about 677.0 μm, and fuel composition no. 4 (2-Ethylhexanoic acid+Base Fuel) exhibited a wear scar of about 692.5 μm. The results provided by Example 3 show a larger wear scar, i.e., poor lubricity performance, for the base fuel only-composition as compared to the three fuel compositions comprising a lubricity additive.

Example 4

Example 4 presents comparative wear scar data for fuel compositions containing the individual lubricity additives, as identified in Table 4, at a lower treat rate of 25 ppm (wt/v) as compared to a treat rate of 50 ppm (wt/v). The base fuels used in Example 4 are as described with respect to Example 1. The selected lubricity additives, including Dodecanamide, N-hydroxy- and 1-Lauroyl-rac-glycerol, were individually added to a respective base fuel. No additional additives or the like were added therein. Accordingly, the formulations tested included comparing fuel composition no. 1 (Dodecanamide, N-hydroxy-+Base Fuel) at a treat rate of 50 ppm (wt/v) with fuel composition no. 2 (Dodecanamide, N-hydroxy-+Base Fuel) at a treat rate of 25 ppm (wt/v). Additionally, fuel composition no. 3 (1-Lauroyl-rac-glycerol+Base Fuel) at a treat rate of 50 ppm (wt/v) was compared with fuel composition no. 4 (1-Lauroyl-rac-glycerol+Base Fuel) at a treat rate of 25 ppm (wt/v). As provided in Example 4, the wear scar values for each fuel composition were determined using a HFRR test method.

TABLE 4

Comparison of Wear Scar Data for Fuel Compositions at 50 ppm (wt/v) and at 25 ppm (wt/v) Treat Rates

| No. | Fuel Compositions | Concentration of Lubricity Additive (ppm weight by volume) | Wear Scar |
|---|---|---|---|
| 1 | Dodecanamide, N-hydroxy- + Base Fuel | 50 | 677.0 |
| 2 | Dodecanamide, N-hydroxy- + Base Fuel | 25 | 756.0 |
| 3 | 1-Lauroyl-rac-glycerol + Base Fuel | 50 | 758.0 |
| 4 | 1-Lauroyl-rac-glycerol + Base Fuel | 25 | 792.5 |

Figure 4:
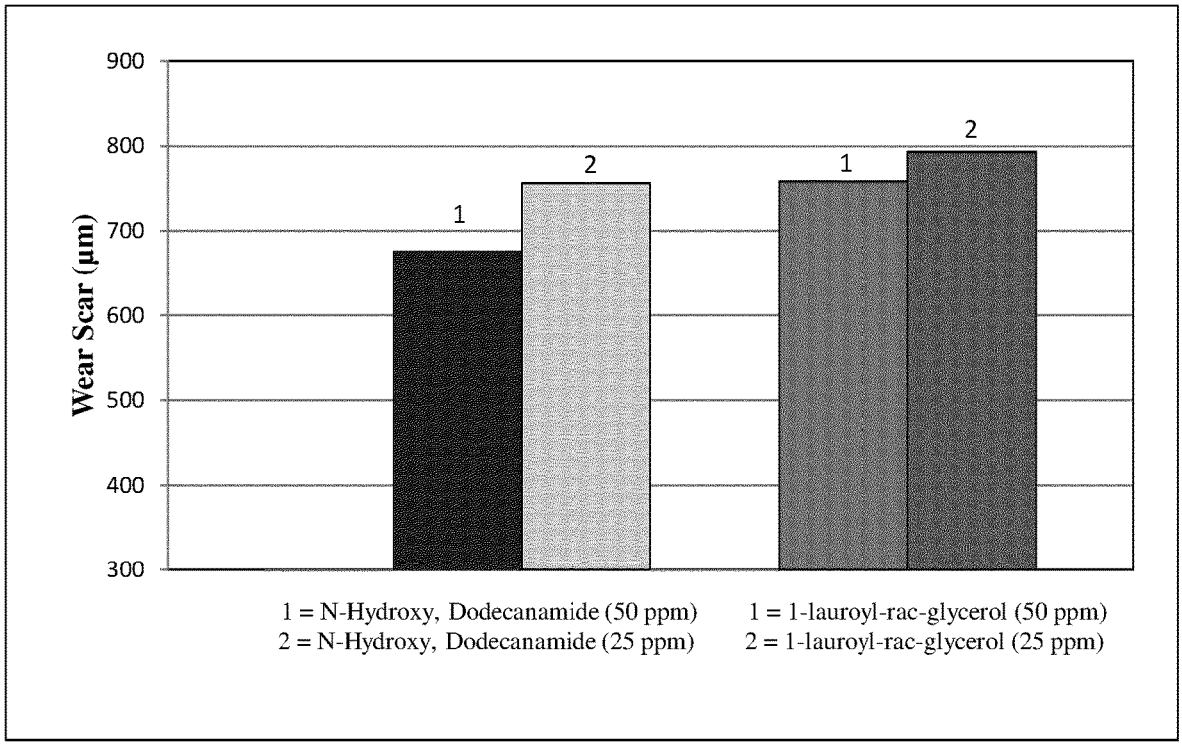
FIG. 4 presents a graphical depiction that compares wear scar values for fuel compositions at a 50 ppm (wt/v) treat rate and at a 25 ppm (wt/v) treat rate.

FIG. 4 presents a graphical depiction that compares the wear scar data for fuel compositions at a 50 ppm (wt/v) treat rate and at a 25 ppm (wt/v) treat rate. The effects that the dose rates have on wear scar data can be further understood by testing of the various fuel compositions at lower lubricity additive treat rates. As provided in Table 4 and as shown in FIG. 4, fuel composition no. 1 (Dodecanamide, N-hydroxy-+Base Fuel) at a 50 ppm (wt/v) treat rate exhibited a wear scar value of about 677.0 while fuel composition no. 2 (Dodecanamide, N-hydroxy-+Base Fuel) at a 25 ppm (wt/v) treat rate exhibited a wear scar value of about 756.0. Additionally, fuel composition no. 3 (1-Lauroyl-rac-glycerol+Base Fuel) at a 50 ppm (wt/v) treat rate exhibited a wear scar value of about 758.0 while fuel composition no. 4 (1-Lauroyl-rac-glycerol+Base Fuel) at a 25 ppm (wt/v) treat rate exhibited a wear scar value of about 792.5. In each instance, the fuel composition comprising a lubricity additive at a 50 ppm (wt/v) treat rate exhibited a lower wear scar value than at a 25 ppm (wt/v) treat rate. However, the wear scar values for all of the fuel compositions, as described with respect to Example 4, were lower than the wear scar value of about 818.9 for the base fuel, as provided in Example 3. Accordingly, each of the fuel compositions of Example 4 provide improvements in wear by providing a reduction in wear scar values as compared to the wear scar value of the base fuel.

Figure 5:
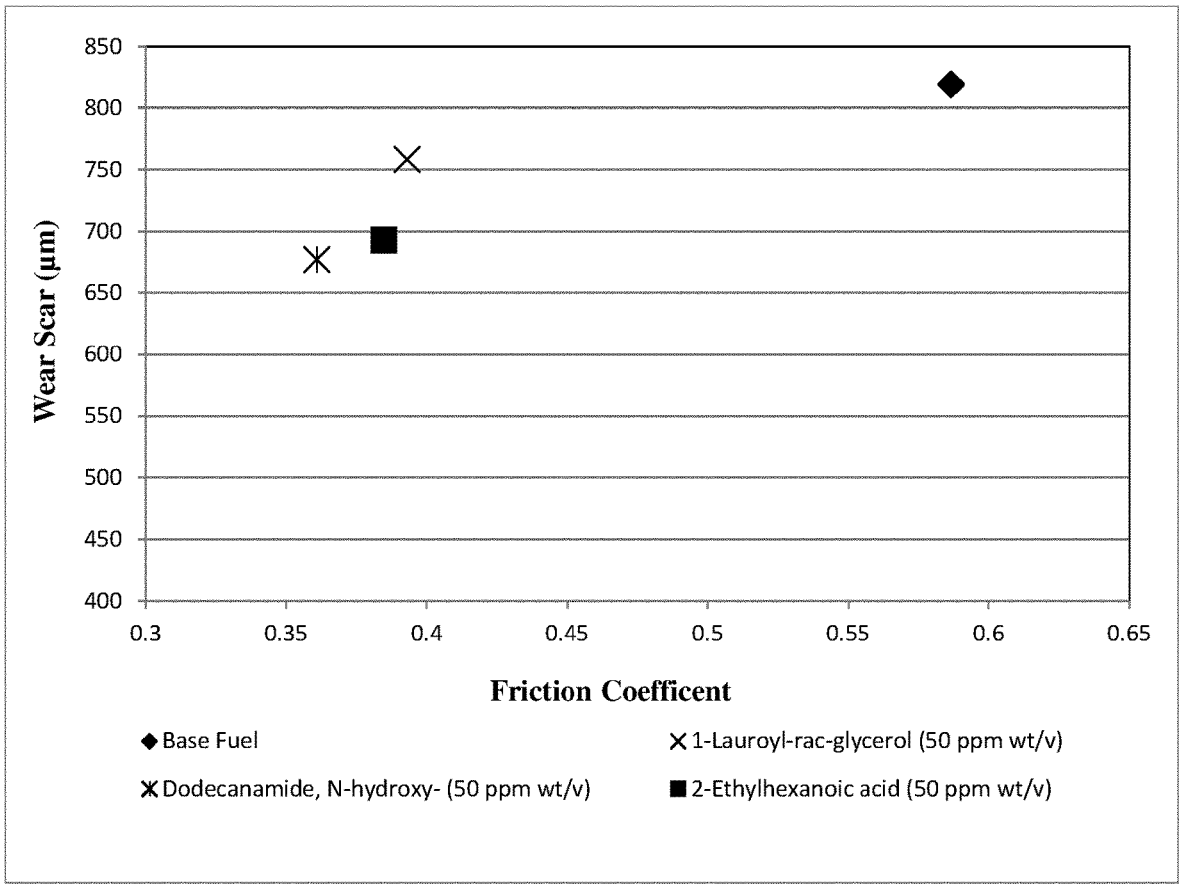
FIG. 5 presents a graphical comparison of wear scar and friction coefficient data for each fuel composition.

FIG. 5 presents a graphical comparison of wear scar and friction coefficient data for each of the fuel compositions. The compositions include a base fuel only composition, a Dodecanamide, N-hydroxy-+Base Fuel composition, a 1-Lauroyl-rac-glycerol+Base Fuel composition, and a 2-Ethylhexanoic acid+Base Fuel composition. The wear scar and the friction coefficient for each inventive fuel composition were plotted against the wear scar and the friction coefficient for the base fuel only composition. When combining such data on one plot, those skilled in the art can readily ascertain that a fuel composition comprising a base fuel and a lubricity additive provides both wear scar and friction reduction when compared to a base only fuel composition.

The objective of the present invention included evaluating various lubricity additives that would increase the lubricating properties of a gasoline fuel when added therein. The lubricity additives were selected based on their unique additive chemistries including varying polar and non-polar groups and were individually added to a gasoline fuel to form a fuel composition, which was later tested to determine its level of lubricity. The results of Examples I-4 indicate that the objectives were met where each fuel composition comprising a lubricity additive demonstrated improved lubricating properties. 1-Lauroyl-rac-glycerol when added to a base fuel as a lubricity additive exhibited improvements in frictional losses and wear scar where friction coefficient data ranged from 0.390 to 0.500 and wear scar data ranged from 755 to 795 μm. Dodecanamide, N-hydroxy- when added to a base fuel as a lubricity additive exhibited improvements in frictional losses and wear scar where friction coefficient data ranged from 0.360 to 0.515 and wear scar data ranged from 675 to 757 μm. 2-Ethylhexanoic acid when added to a base fuel as a lubricity additive exhibited improvements in frictional losses and wear scar where friction coefficient data ranged from 0.385 to 0.465 and wear scar data was about 692 μm.

This synergistic behavior exhibited from combining a gasoline base fuel and a selected lubricity additive demonstrates improved engine efficiency and performance than use of the base fuel only. Such lubricity improvements, including reduced frictional losses and wear scar, provides improved protection to various components of direct injection engines, such as high-pressure fuel pumps and injectors. In another surprising benefit, each fuel composition including the lubricity additive can also be used to improve fuel performance of a direct injection engine or any time of engine suitable for gasoline use.

While the present techniques may be susceptible to various modifications and alternative forms, the exemplary examples discussed above have been shown only by way of example. It is to be understood that the technique is not intended to be limited to the particular examples disclosed herein. Indeed, the present embodiments include all alternatives, modifications, and equivalents falling within the scope of the present techniques.

That we claim:

1. A fuel composition comprising:

a base fuel wherein the base fuel is a blend of gasoline and ethanol wherein the base fuel comprises from 10% by volume to 85% by volume of ethanol;;

from 25 ppm to 100 ppm by weight of a lubricity additive, based on the total weight of the fuel composition;

wherein the lubricity additive consists of 1-Lauroyl-rac-glycerol and wherein the lubricity additive is soluble in the fuel.

2. The fuel composition according to claim 1, wherein the fuel composition has a friction coefficient ranging from 0.390 to 0.500 as measured according to ASTM D6079-11.

3. The fuel composition according to claim 1, wherein the fuel composition has a wear scar diameter ranging from 755 μm to 795 μm as measured according to ASTM D6079-11.

4. A method for improving lubricity of a fuel composition, providing a base fuel wherein the base fuel is a blend of gasoline and ethanol wherein the base fuel comprises from 10% by volume to 85% by volume of ethanol;

adding from 5 ppm to 100 ppm by weight, based on the total weight of the fuel composition, of a lubricity additive to the base fuel to produce the fuel composition;

wherein the lubricity additive consists of 1-Lauroyl-rac-glycerol and wherein the lubricity additive is soluble in the fuel.

5. A method for improving fuel performance of a direct injection engine the method comprising, fueling the direct injection engine with a fuel composition comprising a base fuel wherein the base fuel is a blend of gasoline and ethanol wherein the base fuel comprises from 10% by volume to 85% by volume of ethanol; and from 5 ppm to 100 ppm by weight of a lubricity additive, based on the total weight of the fuel composition; and operating the direct injection engine;

wherein the lubricity additive consists of 1-Lauroyl-rac-glycerol and wherein the lubricity additive is soluble in the fuel.

6. The fuel composition according to claim 1, wherein the base fuel comprises from 15% to 90% by volume of gasoline.

* * * * *